US005766375A

United States Patent [19]

Okamura et al.

[11] Patent Number: 5,766,375

[45] Date of Patent: Jun. 16, 1998

[54] NON-ORIENTED MAGNETIC STEEL SHEET HAVING EXCELLENT BENDING WORKABILITY

[75] Inventors: Susumu Okamura; Etsuji Hino; Yoshinori Fujita, all of Okayama; Masaki Shimizu, Aichi; Tetsuya Aoki, Aichi; Shoichi Takenouchi, Aichi, all of Japan

[73] Assignee: Kawasaki Steel Corporation, Japan

[21] Appl. No.: 821,421

[22] Filed: Mar. 21, 1997

[30] Foreign Application Priority Data

Mar. 21, 1996 [JP] Japan ..... 8-064430

[51] Int. Cl.[6] ..... H01F 1/04

[52] U.S. Cl. ..... 148/307; 148/120; 420/103; 420/117

[58] Field of Search ..... 148/306, 307, 148/120, 121; 420/103, 117

[56] References Cited

U.S. PATENT DOCUMENTS 3,415,696 12/1968 Gimigliano .
4,293,336 10/1981 Matsumura et al. ..... 420/103
4,946,519 8/1990 Honda et al. ..... 148/307
5,045,129 9/1991 Barisoni ..... 148/111

FOREIGN PATENT DOCUMENTS 0 684 320 A1 11/1995 European Pat. Off. .
1-073022 3/1989 Japan .
3-193820 8/1991 Japan .

*Primary Examiner*—John Sheehan
*Attorney, Agent, or Firm*—Austin R. Miller

[57] ABSTRACT

A non-oriented magnetic steel sheet having excellent bending workability and magnetic characteristics is obtained by continuous annealing. The non-oriented magnetic steel sheet is obtained by the method comprising cold rolling a hot-rolled steel sheet, continuously annealing the steel sheet, and then performing skin pass rolling; the steel has a composition comprising about 0.005 mass % or less of C, about 0.05 to 0.30 mass % of Si, about 0.10 to 0.50 mass % of Mn, about 0.15 to 0.50 mass % of Al, and about 0.0050 mass % or less of N.

4 Claims, 3 Drawing Sheets

NON-ORIENTED MAGNETIC STEEL SHEET HAVING EXCELLENT BENDING WORKABILITY

BACKGROUND OF THE INVENTION

1. Field of the Invention

The present invention relates to a method of making a non-oriented magnetic steel sheet, and to a steel sheet product having excellent magnetic characteristics. Particularly, the present invention relates to production of a non-oriented magnetic steel sheet suitable for use in a core of a generator or a motor, which sheet is subjected to bending, and particularly to a process for producing the sheet.

Although non-oriented magnetic steel sheets having low Si contents exhibit poor core loss compared with non-oriented magnetic steel sheets having high Si contents, the low Si steel is inexpensive enough to justify its use as a core material for small generators or motors.

In some cases, such steel sheets are desired to be bent by the user into a special shape. For example, a steel sheet may need to be bent into a cylindrical shape by the user to form a stator core, without providing subsequent strain relief annealing. From the viewpoints of workability and productivity, the non-oriented magnetic steel sheet subjected to bending must possess excellent magnetic characteristics (particularly, core loss) and excellent bending workability without buckling or springback in bending, and must also be inexpensive. The bending workability is generally gauged from observation of buckling defects that are generated after the steel sheet has been worked into a generally cylindrical shape.

2. Description of the Related Art

As inexpensive materials for cores of small generators or motors, non-oriented magnetic steel sheets having a low Si content have been used so far.

Examples of such magnetic steel sheets include continuously annealed materials with a low C content, as disclosed in Japanese Patent Unexamined Publication No. 64-55337, continuously annealed materials with very low C contents as disclosed in Japanese Patent Unexamined Publication No. 55-100927, and semi-processed materials as disclosed in Japanese Patent Unexamined Publication No. 64-73022. These materials are suitable as materials for cores produced by blanking, laminating and, if required, strain relief annealing treatments.

However, these materials cause problems when used as materials for cores produced by bending into cylindrical shapes if this is done without providing a subsequent strain relief annealing step.

Continuously annealed material with a low C content and continuously annealed material with a very low C content have high yield points and yield elongations, and thus are prone to easy buckling and springback. Therefore, these materials have the drawback that they produce buckling defects when bent into a cylindrical or other shape.

The semi-processed material is subjected to skin pass rolling with a rolling reduction of 5 to 10%, and thus has a drawback in that, without strain relief annealing, the magnetic characteristics of the steel significantly deteriorate.

For the purpose of preventing the occurrence of buckling and springback, in order to decrease its yield point and yield elongation, a material having a C content of 0.02 to 0.05 mass % may be cold rolled, and then batch-annealed at a holding temperature of 720° C. for a holding time of about 1 hour to grow crystal grains and precipitate coarse carbide. Since a very low-carbon material causes excessive decrease of hardness after batch annealing, and is thus susceptible to buckling defects in bending, the material is unsuitable for the purpose.

However, low-carbon batch annealed materials (prior art) have the following problems:

1. The steel core loss deteriorates due to a relatively high C content.
2. Steel hardness is increased due to aging by precipitation of carbide, thereby deteriorating core loss.
3. Batch annealing causes significant variations in characteristics (mechanical properties, magnetic characteristics, surface properties) of a steel sheet with its position in a coil.
4. Batch annealing causes low efficiency of production and high costs, as compared with continuous annealing.

SUMMARY OF THE INVENTION

The present invention overcomes the problems of the prior art, and has an object to provide a novel method for making a non-oriented magnetic steel sheet which has excellent bending workability and magnetic characteristics, and can be manufactured with much improved productivity by continuous annealing. The invention further relates to a novel steel sheet produced by the process.

DETAILED DESCRIPTION OF THE PREFERRED EMBODIMENT

Figure 1:
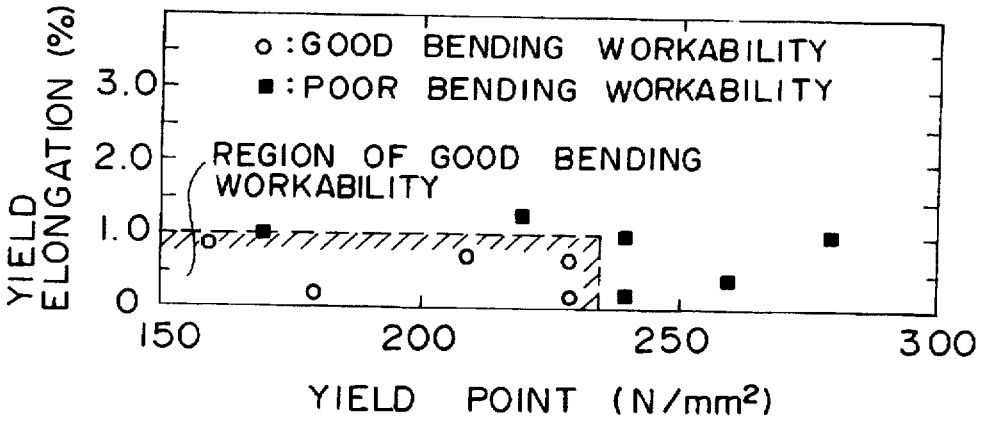
FIG. 1 is a graph showing the relation between the yield point, yield elongation and bending workability of the steel.

As is indicated by FIG. 1 of the drawings, it is important for obtaining good bending workability that the yield point of the steel is about 230 N/mm$^2$ or less, and the yield elongation is about 1% or less. FIG. 1 shows effects of yield point and yield elongation on bending workability. In FIG. 1, the mark ○ indicates good bending workability, and the mark ■ indicates poor bending workability. When a steel sheet can be bent into a cylindrical shape of 80 mmθ without buckling defects, it is considered that its bending workability is good.

We have discovered that it is most effective to employ continuous annealing in order to achieve uniformity of a steel sheet while improving the efficiency of its production, and to decrease the C content of the steel in order to obtain good bending workability and magnetic characteristics. We have further discovered that Al may be added for preventing aging with N, and that the step of skin pass elongation of the steel in skin pass rolling affects yield elongation.

In accordance with this invention, we have provided:

(1) A non-oriented magnetic steel sheet which is intended for bending, which steel is produced by cold rolling a hot-rolled steel sheet, continuously annealing the steel sheet and then performing skin pass rolling, and wherein the steel has a component composition comprising about 0.005 mass % or less of C, about 0.05 to 0.30 mass % or Si, about 0.10 to 0.50 mass % of Mn, about 0.15 to 0.50 mass % of Al, about 0.0050 mass % or less of N, and the balance substantially Fe.

(2) In a non-oriented magnetic steel sheet intended for bending, obtaining quality improvement by controlling the skin pass elongation to about 0.8% or more in skin pass rolling, and yield point and yield elongation to about 230 N/mm$^2$ and about 1% or less, respectively.

(3) In a bendable non-oriented magnetic steel sheet, continuous annealing at a holding temperature of about 700 to 900° C. for a holding time of about 10 to 80 seconds.

(4) A process for producing a non-oriented magnetic steel sheet comprising cold rolling a hot-rolled steel sheet comprising about 0.005 mass % or less of C, about 0.05 to 0.30 mass % or Si, about 0.10 to 0.50 mass % of Mn, about 0.15 to 0.50 mass % of Al, about 0.0050 mass % or less of N, and the balance substantially consisting of Fe, continuously annealing the steel sheet, and then performing skin pass rolling, wherein the skin pass elongation in skin pass rolling is 0.8% or more.

The reasons for limiting the amounts of components of the composition in the method and product of the present invention will be described below.

C: about 0.005 mass % or less

C is a harmful component from the viewpoint of magnetic characteristics. The C content is preferably kept as low as possible in order to reduce the core loss and the amount of age hardening, and to reduce the yield point. However, the permissible upper limit is about 0.005 mass %. Therefore, the C content is about 0.005 mass % or less.

Si: about 0.05 to 0.30 mass %

Si is a useful component for decreasing the core loss by increasing specific resistance, and about 0.05 mass % or more of Si is present for this purpose. However, addition of Si increases hardness, and, as shown by the foregoing experimental results, the yield point increases as the Si content increases. With a Si content of over about 0.30 mass %, the yield point is excessively increased, and good bending workability cannot be obtained with a yield point of over about 230 N/mm$^2$. Therefore, the Si content is about 0.05 mass % to 0.30 mass %.

Mn: about 0.10 to 0.50 mass %

Mn is a useful component for improving hot workability, increasing tensile strength and improving toughness. Mn is also a component which increases specific resistance and thus contributes to a decrease of core loss. With an Mn content of less than about 0.10 mass %, hot workability deteriorates, while with a Mn content of over about 0.50 mass %, the hardness is excessively increased, and the cost is also increased. Therefore, the Mn content is about 0.10 to 0.50 mass %.

Al: about 0.15 to 0.50 mass %

Al is an important component for decreasing core loss by increasing specific resistance, and preventing aging hardening due to presence of N. With an Al content of less than about 0.15 mass %, in hot rolling, Al combines with the N that is contained in the steel to produce fine AlN precipitates which interfere with the growth of crystal grains, thereby deteriorating the core loss. While, with an Al content of over about 0.50 mass %, the yield point and hardness are excessively increased, thereby making practical use impossible. Therefore, the Al content is about 0.15 to 0.50 mass %.

N: about 0.0050 mass % or less

N is a harmful component which forms TiN and AlN as inclusions and which causes aging hardening. The N content is preferably kept as low as possible.

The reasons for limiting the production conditions and preferable production conditions in the present invention will be described below.

The above component composition is prepared by a general steelmaking process such as a converter process, degassing, or the like, followed by continuous casting or casting-ingot making process to form a slab.

The thus-formed slab is hot rolled by hot rolling the slab after re-heating it, or by directly hot rolling the slab without re-heating. If required, the hot-rolled sheet can be subjected to hot-rolled sheet annealing or self annealing in winding after hot rolling.

Thereafter, the hot-rolled sheet is cold rolled. Cold rolling may be carried out once or twice with intermediate annealing therebetween.

The cold-rolled sheet is then continuously annealed, and if required, subjected to overaging, followed by skin pass rolling to form a product. The applicable conditions will be described below.

Continuous annealing

In continuous annealing, the holding temperature is preferably in the range of about 700 to 900° C., and the holding time is preferably about 10 to 80 seconds. The reason for this is that if annealing is carried out at a higher temperature for a longer time, the effect on growth of crystal grains is saturated, and the cost is increased. If annealing is carried out a lower temperature for a shorter time, recrystallization does not sufficiently proceed, and thus magnetism is not improved.

Overaging

Overaging is performed for promoting precipitation of coarse carbide and preventing aging hardening, and may be performed at a holding temperature in the range of about 300 to 500° C. for a holding time in the range of about 15 seconds to 3 minutes according to demand. The reason for this is that overaging at a lower temperature and a shorter time does not produce the sufficient overaging effect, and overaging at a higher temperature and a longer time causes saturation of the overaging effect and thus increases the cost.

Skin pass rolling

In skin pass rolling, the skin pass elongation is important for changing the yield elongation of the steel. We have found that in order to achieve a yield elongation of about 1% or less, the skin pass elongation is about 0.8% or more. However, excess rolling reduction deteriorates the magnetic characteristics of the steel.

An insulating coating may be formed, in a known way, on the surface of the product sheet produced as described above.

Examples were conducted in accordance with the present invention, and will be described below. They are illustrative and are not intended to limit the scope of the invention.

Experiment 1

Each of several hot-rolled plate coils having a thickness of 2.2 mm and different C and Si contents as shown in Table 1 was cold rolled to a thickness of 0.5 mm. The steel sheet was then continuously annealed in a continuous annealing furnace at 800° C. for 1 minute, followed by overaging at 450° C. for 70 seconds. The steel sheet was then subjected to skin pass rolling with a skin pass elongation of 1.2%. The results appear in Table 1.

TABLE 1

| Steel No. | C | Si | Mn | Al | P | S | (mass %) N |
|---|---|---|---|---|---|---|---|
| 1 | 0.0015 | 0.11 | 0.264 | 0.18 | 0.03 | 0.004 | 0.002 |
| 2 | 0.0030 | 0.09 | 0.268 | 0.20 | 0.04 | 0.003 | 0.002 |
| 3 | 0.0050 | 0.08 | 0.272 | 0.20 | 0.03 | 0.004 | 0.003 |
| 4 | 0.0070 | 0.09 | 0.250 | 0.21 | 0.04 | 0.002 | 0.004 |
| 5 | 0.0100 | 0.12 | 0.249 | 0.25 | 0.03 | 0.004 | 0.005 |
| 6 | 0.0030 | 0.05 | 0.255 | 0.23 | 0.05 | 0.003 | 0.003 |
| 7 | 0.0033 | 0.10 | 0.260 | 0.26 | 0.06 | 0.004 | 0.003 |
| 8 | 0.0035 | 0.20 | 0.270 | 0.22 | 0.04 | 0.003 | 0.002 |
| 9 | 0.0033 | 0.30 | 0.251 | 0.23 | 0.03 | 0.004 | 0.003 |
| 10 | 0.0031 | 0.35 | 0.254 | 0.17 | 0.03 | 0.003 | 0.002 |

The core loss ($W_{15/50}$), the amount of aging hardening ($\Delta H_v$ . . . the increase in hardness after allowing to stand for 100 days) and the yield point of each of the thus-obtained steel sheets were examined.

Figure 2:
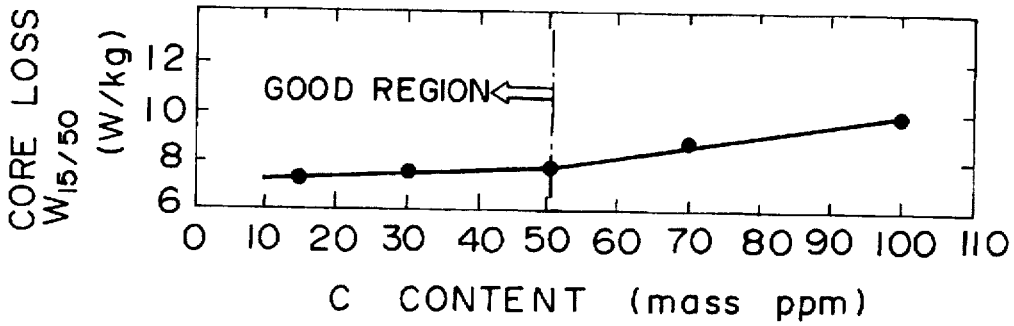
FIG. 2 is a graph showing the relationship between the C content and core loss.
Figure 3:
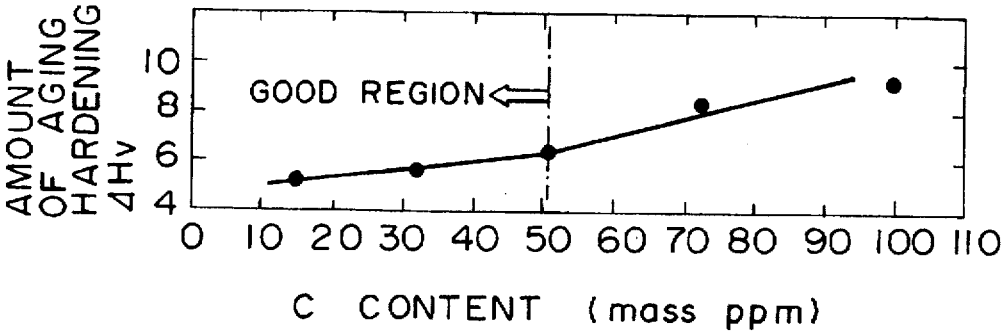
FIG. 3 is a graph showing the relationship between the C content of the steel and the amount of aging hardening.
Figure 4:
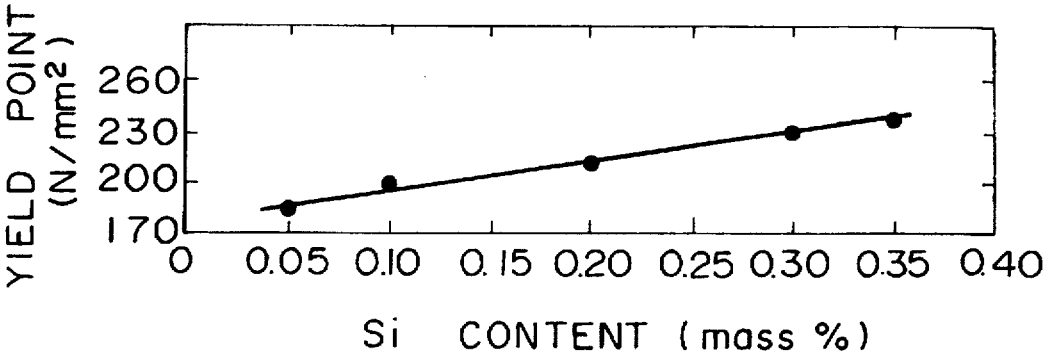
FIG. 4 is a graph showing the relationship between the Si content and yield point.

On the basis of the results of the examination, FIG. 2 is a graph showing the relation between the C content and the core loss ($W_{15/50}$), FIG. 3 is a graph showing the relation between the C content and the amount of age hardening ($\Delta H_v$), and FIG. 4 is a graph showing the relation between the Si content and the yield point.

FIGS. 2 and 3 indicate the tendency that as the C content increases, the core loss and the amount of age hardening increase. It is thus found to be important that in order to suppress the amount of age hardening ($\Delta H_v$) to a low level, and decrease the core loss $W_{15/50}$ to about 8.0 W/kg or less, the C content is about 0.005 mass % or less. Also, the Si content affects not only the core loss but also the yield point. As can be seen from FIG. 4, the yield point increases as the Si content increases, and it is important for achieving a yield point of about 230 N/mm$^2$ or less that the Si content is about 0.3% or less.

Experiment 2

Each of the hot-rolled plate coils having a thickness of 2.2 mm and different Al contents shown in Table 2 was cold rolled to a thickness of 0.5 mm. The steel sheet was then continuously annealed in a continuous annealing furnace at 800° C. for 1 minute, followed by overaging at 450° C. for 80 seconds. The steel sheet was then subjected to skin pass rolling with a skin pass elongation of 1.2%. The results appear in Table 2.

TABLE 2

| Steel No. | C | Si | Mn | Al | P | S | (mass %) N |
|---|---|---|---|---|---|---|---|
| 1 | 0.0031 | 0.15 | 0.220 | 0.002 | 0.04 | 0.004 | 0.003 |
| 2 | 0.0025 | 0.08 | 0.210 | 0.03 | 0.05 | 0.003 | 0.004 |
| 3 | 0.0040 | 0.12 | 0.280 | 0.09 | 0.05 | 0.002 | 0.002 |
| 4 | 0.0033 | 0.10 | 0.230 | 0.12 | 0.03 | 0.004 | 0.003 |
| 5 | 0.0050 | 0.18 | 0.280 | 0.20 | 0.03 | 0.005 | 0.004 |
| 6 | 0.0015 | 0.09 | 0.240 | 0.35 | 0.06 | 0.003 | 0.002 |
| 7 | 0.0045 | 0.11 | 0.264 | 0.18 | 0.03 | 0.003 | 0.003 |
| 8 | 0.0028 | 0.13 | 0.270 | 0.25 | 0.04 | 0.002 | 0.004 |
| 9 | 0.0030 | 0.15 | 0.260 | 0.001 | 0.05 | 0.004 | 0.004 |
| 10 | 0.0020 | 0.14 | 0.255 | 0.46 | 0.04 | 0.003 | 0.002 |

The core loss ($W_{15/50}$) and the amount of age hardening ($\Delta H_v$) of each of the thus-obtained steel sheets were examined.

Figure 5:
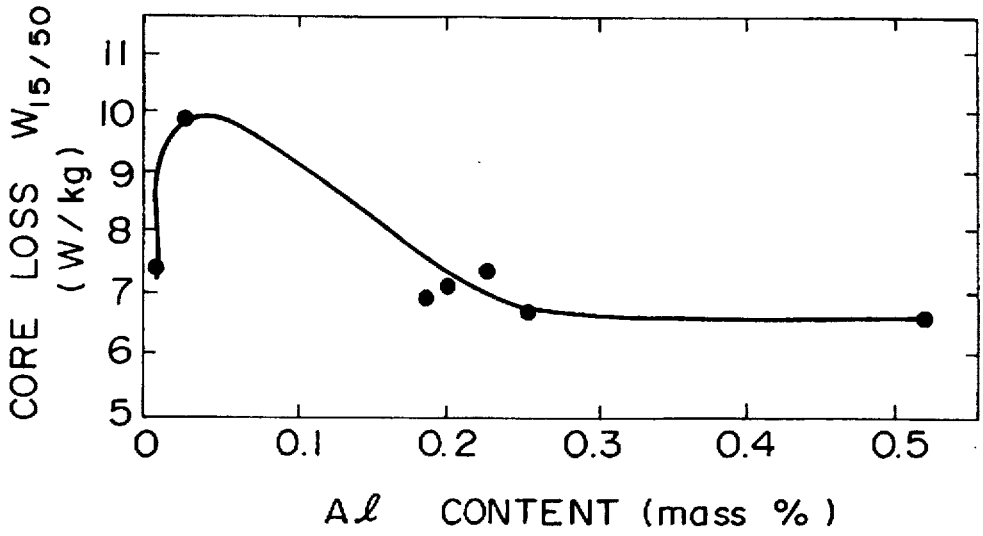
FIG. 5 is a graph showing the relationship between the Al content and core loss.
Figure 6:
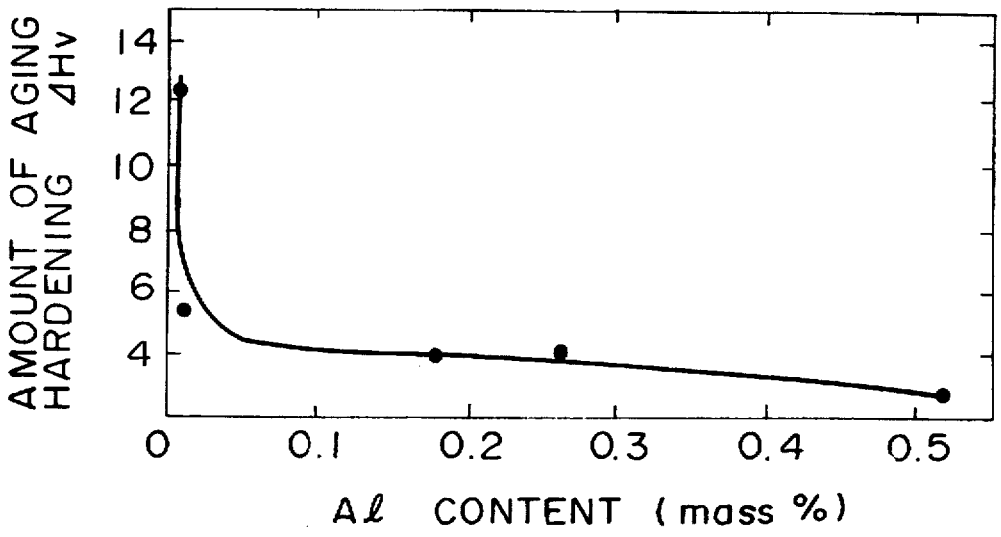
FIG. 6 is a graph showing the relationship between the Al content and the amount of aging hardening.

Based upon the results of the examination, FIG. 5 is a graph showing the relationship between the Al content of the steel and its core loss ($W_{15/50}$), and FIG. 6 is a graph showing the relationship between the Al content and the amount of aging hardening ($\Delta H_v$).

FIG. 5 shows the tendency that the core loss is high with an Al content within the range of about 0.002 to 0.15 mass %, and the core loss gradually decreases as the Al content increases from about 0.15 mass %. This tendency has been discovered to be due to the following fact:

With an Al content within the range of about 0.002 to 0.15 mass %, the growth of crystal grains is inhibited by precipitation of fine AlN, thereby deteriorating the core loss. With an Al content of 0.15 mass % or more, the solid solution limit of AlN is decreased, and thus precipitation of fine AlN in the hot-rolling process can be prevented, thereby improving the core loss. If the Al content is further increased, the core loss is gradually improved by the action of Al as a specific resistance.

FIG. 6 indicates that as the Al content increases, the amount of aging hardening decreases. This shows that aging hardening by N can be prevented by fixing N contained in the steel as AlN.

The calculated amount of Al required for fixing N is about 0.01 mass %, and is significantly smaller than the value experimentally obtained. Namely, this shows that excess Al is required for sufficiently fixing N as AlN.

Experiment 3

In this test a hot-rolled plate coil of 2.4 mm in thickness containing 0.0015 mass % of C, 0.09 mass % of Si, 0.20 mass % of Mn, 0.20 mass % of Al, 0.03 mass % of P, 0.004 mass % of S and 0.003 mass % of N was cold rolled to a thickness of 0.5 mm. The steel sheet was then continuously annealed in a continuous annealing furnace at 750° C. for 70 seconds, followed by overaging at 400° C. for 90 seconds. The steel sheet was then subjected to skin pass rolling with changing the skin pass elongation.

Figure 7:
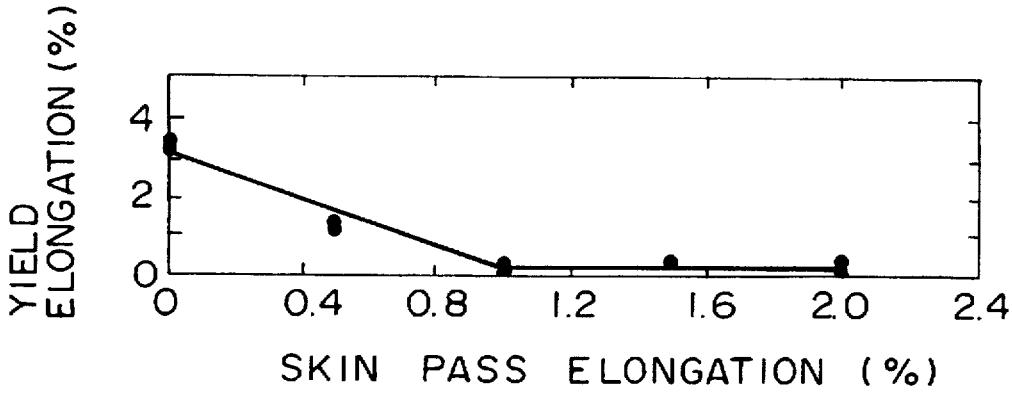
FIG. 7 is a graph showing the relationship between the skin pass elongation and yield elongation of the steel.

The yield elongation of each of the resulting steel sheets was measured. FIG. 7 shows their yield elongations and the effect of skin pass on each.

FIG. 7 indicates that with a skin pass elongation of less than 0.8%, the yield elongation increased as the skin pass elongation decreased. It is found to be important that in order to suppress the yield elongation to about 1% or less, the skin pass elongation is about 0.8% or more.

Each of steel slabs used as materials and having the component compositions shown in Table 3 was hot rolled to a thickness of 2.3 mm, washed with an acid and then cold rolled to form a cold-rolled sheet having a thickness of 0.5 mm.

TABLE 3

| Steel No. | C | Si | Mn | Al | P | S | (mass %) N | Remarks |
|---|---|---|---|---|---|---|---|---|
| 1 | 0.0015 | 0.07 | 0.24 | 0.23 | 0.03 | 0.003 | 0.002 | Suitable steel |
| 2 | 0.0040 | 0.12 | 0.22 | 0.19 | 0.04 | 0.004 | 0.003 | Suitable steel |
| 3 | 0.0042 | *0.40 | 0.25 | 0.21 | 0.03 | 0.003 | 0.003 | Comparative steel |
| 4 | *0.0130 | 0.23 | 0.30 | 0.25 | 0.04 | 0.004 | 0.005 | Comparative steel |
| 5 | 0.0025 | *0.04 | 0.26 | 0.20 | 0.03 | 0.002 | 0.002 | Comparative steel |

TABLE 3-continued (mass %)

| Steel No. | C | Si | Mn | Al | P | S | N | Remarks |
|---|---|---|---|---|---|---|---|---|
| 6 | 0.0030 | 0.13 | *0.07 | 0.26 | 0.04 | 0.004 | 0.004 | Comparative steel |
| 7 | 0.0022 | 0.10 | *0.62 | 0.19 | 0.04 | 0.004 | 0.002 | Comparative steel |
| 8 | 0.0018 | 0.10 | 0.24 | 0.005 | 0.04 | 0.005 | 0.003 | Comparative steel |
| 9 | 0.0029 | 0.14 | 0.22 | 0.53 | 0.02 | 0.004 | 0.002 | Comparative steel |
| 10 | 0.0026 | 0.11 | 0.25 | 0.0007 | 0.03 | 0.003 | 0.003 | Comparative steel |

Note:
Mark * indicates a content out of the limited range of the present invention.

The thus-formed cold-rolled sheet was continuously annealed in a continuous annealing furnace at 750° C. for 60 seconds, followed by overaging at 400° C. for 20 seconds. (In the comparative examples, overaging was not performed.) The steel sheet was then subjected to skin pass rolling with changing skin pass elongation to form products. (In the comparative examples, skin pass rolling was not carried out.)

The core loss, the amount of aging hardening (an increase in hardness after allowing to stand for 100 days), the yield point and the yield elongation of each of the products were measured.

The presence of overaging, the skin pass elongation and the results of measurement of characteristics of the products are summarized in Table 4.

TABLE 4

| | Production condition | | | Product properties | | | | |
|---|---|---|---|---|---|---|---|---|
| Steel No. | Steel No. | Presence of overaging | Skin pass rolling elongation (%) | Core loss $W_{15/50}$ (W/kg) | Amount of age hardening (ΔHz) | Yield point (N/mm$^2$) | Yield elongation (%) | Remarks |
| 1 | 1 | present | 1.5 | 7.6 | 5 | 180 | 0.7 | Suitable ex. |
| 2 | 1 | present | 2.0 | 7.5 | 5 | 190 | 0.8 | Suitable ex. |
| 3 | 1 | present | *0.5 | 7.6 | 5 | 170 | 2.5 | Comp. ex. |
| 4 | 1 | present | *0 | 7.9 | 5 | 160 | 3.7 | Comp. ex. |
| 5 | 1 | absent | 1.5 | 7.6 | 7 | 205 | 0.8 | Suitable ex. |
| 6 | 2 | present | 1.0 | 7.2 | 4 | 203 | 0.2 | Suitable ex. |
| 7 | 2 | present | 1.8 | 7.2 | 5 | 220 | 0.2 | Suitable ex. |
| 8 | 2 | prsent | *0.5 | 7.2 | 4 | 210 | 2.0 | Comp. ex. |
| 9 | 2 | present | *0 | 7.1 | 5 | 200 | 2.2 | Comp. ex. |
| 10 | *3 | present | 1.2 | 6.8 | 5 | 270 | 0.8 | Comp. ex. |
| 11 | *4 | present | 1.3 | 11.5 | 12 | 280 | 0.9 | Comp. ex. |
| 12 | *5 | present | 1.0 | 8.4 | 5 | 162 | 0.7 | Comp. ex. |
| 13 | *6 | present | 1.1 | 8.2 | 4 | 175 | 1.0 | Comp. ex. |
| 14 | *7 | present | 1.2 | 7.0 | 5 | 252 | 0.8 | Comp. ex. |
| 15 | *8 | present | 1.0 | 9.8 | 4 | 172 | 0.3 | Comp. ex. |
| 16 | *9 | present | 1.1 | 6.5 | 3 | 235 | 0.5 | Comp. ex. |
| 17 | *10 | present | 1.2 | 7.5 | 13 | 178 | 0.3 | Comp. ex. |

Note:
Mark * indicates a content out of the limited range of the present invention Table 4 indicates that each of Samples Nos. 3, 4, 8 and 9 of the comparative examples with skin pass elongation out of the limited range of the present invention, and Samples Nos. 10 to 17 of the comparative examples with the composition out of the limited range of the present invention shows a high value of at least one of core loss, amount of age hardening, yield point and yield elongation. On the other hand, all of Samples Nos. 1, 2, 6 and 7 of the present invention showed a core loss $W_{15/50}$ of about 7.6 W/kg or less, an amount of age hardening ($\Delta H_v$) of about 5 or less, a yield point of about 220 N/mm$^2$ and a yield elongation of about 0.8% or less.

The blanking and bending workabilities of each the steel sheets of the examples of the invention were examined, and then a generator was assembled to examine the efficiency of power generation. As a result, it was found that the blanking and bending workabilities were the same as conventional materials which are subjected to batch annealing, but that the efficiency of power generation was improved by 1% or more due to improvement of the core loss, as compared with products formed of conventional materials.

The present invention provides a non-oriented magnetic steel sheet with excellent bending workability and core loss which is produced by cold rolling a very low-carbon steel sheet having a limited component composition and then continuously annealing the steel sheet. The invention further relates to a process for producing the steel sheet. The present invention employs continuous annealing so that variation in quality of products can be decreased, and the efficiency of production of steel sheets can significantly be improved, as compared with conventional batch annealing. Furthermore, it is possible to achieve improvements in the efficiency of a generator and a motor due to a reduction of core loss, and the efficiency of production of a generator and of a motor due to improvement of bending workability of the steel.

What is claimed is:

1. A non-oriented magnetic steel sheet having excellent bending workability having been prepared by cold rolling, continuously annealing and skin pass rolling, said steel sheet having a skin pass elongation of about 0.8% or more, a yield point of about 230 N/m$^2$ or less, yield point elongation of about 1% or less, and a component composition comprising about 0.005 mass % or less of C, about 0.05 to 0.30 mass % of Si, about 0.10 to 0.50 mass % of Mn, about 0.15 to 0.50 mass % of Al, about 0.0050 mass % or less of N, and the balance substantially Fe.

2. A process for producing a non-oriented magnetic steel sheet with excellent bending workability, comprising:

cold rolling a hot-rolled steel sheet having a component composition comprising about 0.005 mass % or less of C, about 0.05 to 0.30 mass % of Si, about 0.10 to 0.50 mass % of Mn, about 0.15 to 0.50 mass % of Al, about 0.0050 mass % or less of N, and the balance substantially consisting of Fe;

continuously annealing the steel sheet; and subsequently performing skin pass rolling; wherein the skin pass elongation of said skin pass rolling is about 0.8% or more.

3. A method according to claim 2, wherein the continuous annealing is performed at a holding temperature of about 700 to 900° C. for a holding time of about 10 to 80 seconds.

4. A method according to claim 2, wherein, after continuous annealing and prior to skin pass rolling, overaging is performed at a holding temperature of about 300 to 500° C. for a holding period of about 15 seconds to 3 minutes.

* * * * *

UNITED STATES PATENT AND TRADEMARK OFFICE

CERTIFICATE OF CORRECTION

PATENT NO. : 5,766,375

DATED : June 16, 1998

INVENTOR(S) : Susumu Okamura, et al

It is certified that error appears in the above-indentified patent and that said Letters Patent is hereby corrected as shown below:

In column 7, at table 4, at the subheading "Presence of overaging", at line 8, please change "prsent" to --present--; and at the subheading "Amount of age hardening", at line 15, please change "4" to --5--.

Signed and Sealed this

Third Day of November, 1998

Bruce Lehman

*Attest:*

BRUCE LEHMAN

*Attesting Officer*

*Commissioner of Patents and Trademarks*